US006780830B1

(12) United States Patent
Huish et al.

(10) Patent No.: US 6,780,830 B1
(45) Date of Patent: Aug. 24, 2004

(54) POST-ADDED α-SULFOFATTY ACID ESTER COMPOSITIONS AND METHODS OF MAKING AND USING THE SAME

(75) Inventors: Paul Danton Huish, Salt Lake City, UT (US); Laurie A. Jensen, Midvale, UT (US); Pule B. Libe, Salt Lake City, UT (US)

(73) Assignee: Huish Detergents, Incorporated, Salt Lake City, UT (US)

( * ) Notice: Subject to any disclaimer, the term of this patent is extended or adjusted under 35 U.S.C. 154(b) by 0 days.

(21) Appl. No.: 09/704,256

(22) Filed: Nov. 1, 2000

Related U.S. Application Data

(63) Continuation-in-part of application No. 09/574,764, filed on May 19, 2000, now Pat. No. 6,534,464.

(51) Int. Cl.[7] ..... C11D 1/28; C11D 1/66; C11D 17/00

(52) U.S. Cl. ..... 510/446; 510/127; 510/137; 510/138; 510/155; 510/156; 510/445; 510/447; 510/488; 510/492; 510/440

(58) Field of Search ..... 510/127, 137, 510/138, 155, 156, 445, 446, 447, 488, 492, 440

(56) References Cited

U.S. PATENT DOCUMENTS

| | | | | | |
|---|---|---|---|---|---|
| 4,416,809 | A | | 11/1983 | Magari et al. | |
| 4,438,025 | A | * | 3/1984 | Satsuki et al. | 252/545 |
| 4,476,043 | A | * | 10/1984 | O'Lenick | 252/544 |
| 4,487,710 | A | * | 12/1984 | Kaminsky | 252/546 |
| 4,488,989 | A | | 12/1984 | Lamberti | |
| 4,552,681 | A | * | 11/1985 | Koch et al. | 252/140 |
| 4,597,898 | A | * | 7/1986 | Vander Meer | 252/529 |
| 4,705,644 | A | * | 11/1987 | Barone et al. | 252/135 |
| 5,104,567 | A | | 4/1992 | Staehr | |
| 5,143,639 | A | | 9/1992 | Krawack | |
| 5,380,453 | A | | 1/1995 | Krawack | |
| 5,482,644 | A | | 1/1996 | Nguyen et al. | |
| 5,602,089 | A | | 2/1997 | Pennaz | |
| 5,616,781 | A | | 4/1997 | Sajic et al. | |
| 5,637,758 | A | | 6/1997 | Sajic et al. | |
| 5,851,976 | A | | 12/1998 | Mertens | |
| 5,945,394 | A | | 8/1999 | Sajic et al. | |
| 5,965,500 | A | | 10/1999 | Puvvada | |
| 5,972,861 | A | | 10/1999 | Rolfes | |
| 6,013,611 | A | | 1/2000 | Thomas et al. | |
| 6,046,151 | A | | 4/2000 | Drapier et al. | |
| 6,057,280 | A | * | 5/2000 | Huish et al. | 510/440 |
| 6,060,440 | A | | 5/2000 | Sackariasen et al. | |
| 6,288,020 | B1 | * | 9/2001 | Huish et al. | 510/440 |
| 6,303,558 | B1 | | 10/2001 | Emery et al. | 510/424 |
| 6,407,050 | B1 | * | 6/2002 | Huish et al. | 510/357 |
| 6,468,956 | B1 | * | 10/2002 | Huish et al. | 510/428 |
| 6,509,310 | B1 | * | 1/2003 | Huish et al. | 510/446 |
| 6,683,039 | B1 | * | 1/2004 | Huish et al. | 510/357 |

FOREIGN PATENT DOCUMENTS

| | | | |
|---|---|---|---|
| DE | 3237001 | | 4/1984 |
| EP | 336740 | * | 1/1995 |
| GB | 2 151 656 A | | 11/1984 |
| WO | WO 93/12216 | | 6/1993 |

OTHER PUBLICATIONS

Technical Bulletin—"EMPIGEN OB/EBA" by Albright & Wilson.

Synthetic Detergents (7th ed.) A.S. Davidsohn & B. Milwidsky pp. 263–64.

Database WPI, Week 9025, Derwent Publications Ltd. (XP002240608).

Supplementary European Search Report received for corresponding EP patent application, dated May 22, 2003.

* cited by examiner

*Primary Examiner*—Gregory R. Del Cotto
(74) *Attorney, Agent, or Firm*—Townsend and Townsend and Crew LLP

(57) ABSTRACT

Compositions and method of making compositions comprising α-sulfofatty acid ester and other detergent components. The α-sulfofatty acid ester is formed into a first portion, and the other detergent components are formed into a second portion. The first portion is post-added to the second portion.

21 Claims, No Drawings

POST-ADDED α-SULFOFATTY ACID ESTER COMPOSITIONS AND METHODS OF MAKING AND USING THE SAME

RELATED APPLICATIONS

The present application is a continuation-in-part of U.S. patent application Ser. No. 09/574,764, filed May 19, 2000 now U.S. Pat. No. 6,534,464.

BACKGROUND OF THE INVENTION

The present invention generally relates to surfactant compositions and methods for making and using such compositions. More particularly, the invention relates to compositions containing post-added α-sulfofatty acid esters with detergent components, and methods for making and using the same.

Soaps made from animal fats have been used for many years to clean dishes, utensils and other materials. More recently, cleaning compositions have been formulated using other surfactants to enhance their cleaning performance. Typical surfactants include anionics, nonionics, zwitterionics, ampholytics, cationics and those described in. Surface Active Agents, Volumes I and II by Schwartz, Perry and Berch (New York, Interscience Publishers), in Nonionic Surfactants, ed. by M. J. Schick (New York, M. Dekker, 1967), and in McCutcheon's Emulsifiers & Detergents (1989 Annual, M. C. Publishing Co.), the disclosures of which are incorporated herein by reference.

Anionic surfactants are a preferred surfactant for many cleaning applications due to the improved surface agent properties of these surfactants. A variety of anionic surfactants have been developed for cleaning applications. Linear alkyl sulfonates ("LAS") and alkybenzene sulfonates ("ABS") are two popular anionic surfactants. These surfactants are used alone or in combination with soaps (i.e., fatty acids), depending on the desired properties of the final composition. The use of ABS as surfactants has recently fallen into disfavor, however, due to their lesser biodegradability. The use of ABS and LAS surfactants is also disfavored for hard water applications, where the detergency of these surfactants decreases.

Recently, interest in α-sulfofatty acid esters (also referred to hereafter as "sulfofatty acids") has increased due to the superior cleaning properties of these surfactants in hard water. For example, methyl ester sulfonates ("MES") retain higher detergency values than LAS or ABS as water hardness increases. Such improved hard water cleaning performance is beneficial because it allows this surfactant to be used in a wider variety of cleaning applications. This hard water "tolerance" is also beneficial because hard water is used in many areas of the world for cleaning.

The use of α-sulfofatty acid esters has not been widely accepted, however, due to several disadvantages of such sulfofatty acids. α-Sulfofatty acid esters are typically manufactured as salts. α-Sulfofatty acid ester salts are typically a mixture of salt forms (e.g., mono- and di-salts). For example, MES has both mono- and di-salt forms (i.e., mono-sodium MES and di-sodium MES). While mono-salts of α-sulfofatty acid esters have the desired surface active agent properties, di-salts have several undesirable properties that degrade the performance of the resulting composition. For example, the Kraft point of a $C_{16}$ methyl ester sulfonate ("MES") di-salt is 65° C., as compared to 17° C. for the mono-salt form of $C_{16}$ MES. (The Kraft point is the temperature at which the solubility of an ionic surfactant becomes equal to its critical micelle concentration; below the Kraft point, surfactants form precipitates instead of micelles.): Higher proportions of di-salt cause more precipitation. The presence of large amounts of di-salts in α-sulfofatty acid ester, therefore, results in a poorer quality α-sulfofatty acid ester product, characterized by degraded performance and reduced application flexibility.

A related problem is that di-salts result from hydrolysis of α-sulfofatty acid ester during storage and in detergent formulations. In particular, mono-salts of α-sulfofatty acid ester hydrolyze in the presence of moisture and alkali-containing detergent components to form di-salts. For example, mono-sodium MES reacts with caustic soda (NaOH) in the presence of moisture to form a di-salt by the following reaction:

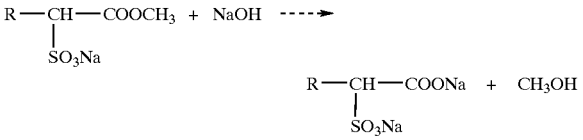

In formulations where mono-sodium MES is well mixed with high pH components under aqueous conditions, the MES will hydrolyze nearly completely to the di-salt form. High pH components include builders, such as silicates or carbonates, and bases, such as sodium, hydroxide (NaOH). This chemical instability discourages the use of α-sulfofatty acid esters in many cleaning applications.

Thus, there exists a need for cleaning compositions containing α-sulfofatty acid ester that exhibit reduced di-salt formation by the, sulfofatty acid and hard water tolerance. The present invention surprisingly satisfies this need and more.

SUMMARY OF THE INVENTION

The present invention includes compositions comprising α-sulfofatty acid ester that is post-added to other detergent components. The compositions comprise at least two portions. The first portion contains α-sulfofatty acid ester. In one embodiment, the α-sulfofatty acid portion consists of α-sulfofatty acid ester and its manufacturing byproducts. In another embodiment, the α-sulfofatty acid portion comprises other detergent components. In another embodiment, the α-sulfofatty acid ester portion is free of additional detergent components that cause more than a minor amount of additional di-salt formation.

The second portion comprises other detergent components, according to the desired properties of the final composition. For example, such components can include, but are not limited to, secondary anionic surfactants, nonionic surfactants, cationic surfactants, zwitterionic surfactants, polymer dispersants, oxidizing agents, biocidal agents, foam regulators, foam stabilizers, binders, anticaking agents, activators, builders, hydrotropes, catalysts, thickeners, stabilizers, UV protectors, fragrances, soil suspending agents, polymeric soil release agents, fillers, brighteners, enzymes, salts, inert ingredients, and the like. In a preferred embodiment, the second portion includes detergent components that cause more than a minor amount of additional di-salt formation.

The first portion is prepared by providing the α-sulfofatty acid ester, optionally combining the α-sulfofatty acid ester with any other detergent components, as desired, and then forming the first portion. The second portion is formed by combining other detergent components and then forming them into the second portion. The first portion is post-added to the second portion by admixing the first portion with the second portion. Because the second portion is typically formed by processes, or includes detergent components, that cause additional di-salt formation, the amount of additional di-salt formation is reduced by post-adding the first portion to the second portion after such di-salt forming processes are completed, or partially segregating the α-sulfofatty acid ester from such di-salt forming components.

Each portion typically comprises a plurality of particles, such as a powder, or beads, pellets, granules, and the like. When the portions are admixed, the particles are co-mingled, but remain physically distinct. In one embodiment, the moisture content of the second portion is reduced prior to admixing it with the first portion. The portions can be combined in any suitable ratios, according to the desired properties of the final composition. In another embodiment, the particles of either portion can be coated to further reduce additional di-salt formation or to protect the components from moisture. Other detergent components, such as, for example, fragrances and/or enzymes, can also be added to the admixture as separate portions.

For any of the compositions and methods in accordance with the present invention, the first portion can be formed by, for example, dry-blending, agglomeration and fluid bed mixing. Such methods preferably do not cause more than a minor amount of additional di-salt formation in the first portion. The second portion can be formed by, for example, dry-blending, agglomerating, spray drying, fluid bed mixing, as well as by other methods known to the skilled artisan.

DETAILED DESCRIPTION OF THE PREFERRED EMBODIMENTS

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent and pharmaceutical industries. Moreover, the processes below describe only steps, rather than a complete process flow, for manufacturing the compositions, and detergents containing the compositions, in accordance with the present invention.

A preferred embodiment is directed to compositions comprising post-added α-sulfofatty acid ester. The α-sulfofatty acid ester is formed into a first portion, an α-sulfofatty acid first portion. The second portion comprises other detergent components.

The First Portion

In a preferred embodiment; the first portion comprises at least one α-sulfofatty acid ester. Such an α-sulfofatty acid ester has an ester linkage between a carboxylic acid and an alkanol and is sulfonated at the α-position of the carboxylic acid. The α-sulfofatty acid ester is typically of the following formula (I):

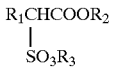

(I)

where $R_1$ is a linear or branched alkane, $R_2$ is a linear or branched alkane, and $R_3$ is hydrogen, a halogen, a mono-valent or di-valent cation, or an unsubstituted or substituted ammonium cation. $R_1$ can be $C_4$–$C_{24}$, including a $C_{10}$, $C_{12}$, $C_{14}$, $C_{16}$ and/or $C_{18}$ alkane. $R_2$ can be $C_1$ to $C_8$, including a methyl group. $R_3$ is typically a mono-valent or di-valent cation, such as a cation that forms a water soluble salt with the α-sulfofatty acid ester (e.g., an alkali metal salt such as sodium, potassium or lithium). The α-sulfofatty acid ester of formula (I) can be a methyl ester sulfonate, such as a $C_8$ to $C_{18}$ methyl ester sulfonate.

More typically, the α-sulfofatty acid ester is a salt, which is generally of the following formula (II):

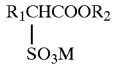

(II)

where $R_1$ and $R_2$ are alkanes and M is a monovalent metal. For example, $R_1$ can be an alkane containing 4 to 24 carbon atoms, and is typically a $C_8$, $C_{10}$, $C_{12}$, $C_{14}$, $C_{16}$ and/or $C_{18}$ alkane. $R_2$ is typically an alkane containing 1 to 8 carbon atoms, and more typically a methyl group. M is typically an alkali metal, such as sodium or potassium. The α-sulfofatty acid ester of formula (II) can be a sodium methyl ester sulfonate, such as a sodium $C_8$–$C_{18}$ methyl ester sulfonate.

In one embodiment, the α-sulfofatty acid ester is a $C_8$, $C_{10}$, $C_{12}$, $C_{14}$, $C_{16}$ or $C_{18}$ α-sulfofatty acid ester. In another embodiment, the α-sulfofatty acid ester comprises a mixture of different chain length α-sulfofatty acid esters. For example, the first portion can comprise a mixture of α-sulfofatty acid esters, such as $C_8$, $C_{10}$, $C_{12}$, $C_{14}$, $C_{16}$ and $C_{18}$ sulfofatty acids. Such a mixture of α-sulfofatty acid esters can be prepared from a natural fat or oil, such as any of those described below.

In yet another embodiment, the α-sulfofatty acid ester is a mixture of different chain lengths, where the proportions of the different chain lengths are selected according to the properties of the (α-sulfofatty acid esters. For example, $C_{16}$ and $C_{18}$ sulfofatty acids (e.g., from tallow and/or palm stearin MES) generally provide better surface active agent properties, but are less soluble in aqueous solutions. $C_8$, $C_{10}$, $C_{12}$ and $C_{14}$ α-sulfofatty acid esters (e.g., from palm kernel oil or coconut oil) are more soluble in water, but have lesser surface active agent properties. Suitable mixtures of such α-sulfofatty acid esters include $C_8$, $C_{10}$, $C_{12}$ and/or $C_{14}$ α-sulfofatty acid esters combined with $C_{16}$ and/or $C_{18}$ α-sulfofatty acid esters. For example, about 1 to about 99 percent of $C_8$, $C_{10}$, $C_{12}$ and/or $C_{14}$ α-sulfofatty acid ester is combined with about 99 to about 1 weight percent of $C_{16}$ and/or $C_{18}$ α-sulfofatty acid ester. In another embodiment, the mixture comprises about 1 to about 99 weight percent of a $C_{16}$ or $C_{18}$ α-sulfofatty acid ester and about 99 to about 1 weight percent of a $C_{16}$ or $C_{18}$ α-sulfofatty acid ester.

The composition can also be enriched for certain chain length α-sulfofatty acid esters, as disclosed in co-pending U.S. patent application Ser. No. 09/574,996 filed May 19, 2000, to provide the desired surfactant properties. The disclosure of that application is incorporated by reference herein in its entirety. For example, α-sulfofatty acid esters prepared from natural sources, such as palm kernel (stearin) oil, palm kernel (olein) oil, or beef tallow, are enriched for $C_{16}$ and/or $C_{18}$ α-sulfofatty acid esters by addition of the certain chain length (purified or semi-purified) α-sulfofatty acid esters to a mixture of α-sulfofatty acid esters. α-Sulfofatty acid esters prepared from other sources can also be enriched for one or more chain length α-sulfofatty acid esters, such as $C_{16}$ and/or $C_{18}$ α-sulfofatty acid esters. Suitable ratios for enrichment range from greater than 0.5:1, to about 1:1, to about 1.5:1, to greater than 2:1, and up to about 5–6:1, or more, of $C_{16}$or $C_{18}$ to other chain length α-sulfofatty acid esters. An enriched mixture can also comprise about 50 to about 60 weight percent $C_8$–$C_{18}$ α-sulfofatty acid esters and about 40 to about 50 weight percent $C_{16}$ α-sulfofatty acid ester.

Methods of preparing α-sulfofatty acid esters are known to the skilled artisan. (See, e.g., U.S. Pat. Nos. 5,587,500; 5,384,422; 5,382,677; 5,329,030; 4,816,188; and 4,671,900; and *The Journal of American Oil Chemists Society* 52:323–29 (1975); the disclosures of which are incorporated herein by reference.) α-Sulfofatty acid esters can be prepared from a variety of sources, including beef tallow, palm kernel oil, palm kernel (olein) oil, palm kernel (stearin) oil, coconut oil, soybean oil, canola oil, cohune oil, coco butter, palm oil, white grease, cottonseed oil, corn oil, rape seed oil, soybean oil, yellow grease, mixtures thereof or fractions thereof. Suitable fatty acids to make α-sulfofatty acid esters include, but are not limited to, caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. α-Sulfofatty acid esters prepared from one or more of these sources are within the scope of the present invention.

Compositions according to the present invention comprise an effective amount of α-sulfofatty acid ester (i.e., an amount which provides the desired anionic surface active agent properties). In one embodiment, an effective amount is at least about 5 weight percent α-sulfofatty acid ester. In another embodiment, an effective amount is at least about 10 weight percent α-sulfofatty acid ester. In still another embodiment, an effective amount is at least about 15 weight percent, at least about 20 weight percent, at least about 25 weight percent, or at least about 35 weight percent. These weight percentages are based on the total weight of the composition.

In one embodiment, the first portion contains only α-sulfofatty acid ester, and its manufacturing by-products. In another embodiment, the first portion further includes other detergent components, such as, for example, sodium chloride, sodium sulfate, sodium polyacrylate, and the like. In a preferred embodiment, the first portion is substantially free of other detergent components that cause more than a minor amount of additional di-salt formation. As used herein, the term "less than a minor amount" means less than about 30 weight percent, typically less than about 15 weight percent, and more typically less than about 7 weight percent additional di-salt formation. The preceding ranges apply to additional di-salt formation and exclude di-salt already present in the α-sulfofatty acid ester as a result of the manufacturing process. The method of George Battaglini et al., *Analytical Methods for Alpha Sulfo Methyl Tallowate*, JOACS, Vol. 63, No. 8 (August 1986), the disclosure of which is incorporated herein by reference, can be used to determine the amount of di-salt in an α-sulfofatty acid ester sample, and any increase in such a sample as compared with a control sample.

The Second Portion

The second (detergent) portion comprises other detergent components, according to the desired properties of the final composition. Such components include secondary anionic surfactants, nonionic surfactants, cationic surfactants, zwitterionic surfactants, polymer dispersants, oxidizing agents, biocidal agents, foam regulators, foam stabilizers, binders, anticaking agents, activators, builders, hydrotropes, catalysts, thickeners, stabilizers, UV protectors, fragrances, soil suspending agents, polymeric soil release agents, fillers, brighteners, enzymes, salts, inert ingredients, and the like.

Suitable nonionic surfactants include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, and glycerol fatty acid esters. Other suitable surfactants include those disclosed in U.S. Pat. Nos. 5,945,394 and 6,046,149, the disclosures of which are incorporated herein by reference. In another embodiment, the second portion is substantially free of nonylpbenol nonionic surfactants. In this context, the term "substantially free" means less than about one weight percent.

In a preferred embodiment, the nonionic surfactant is an alkanolamide of the following formula (III):

$$R_7\overset{\overset{\displaystyle O}{\|}}{C}NR_8-R_9 \qquad \text{(III)}$$

where $R_7$ is an alkyl, alkenyl, alkylene, or hydroalkyl group. $R_8$ and $R_9$ are independently selected from hydrogen, alkyl, or hydroalkyl. $R_7$ is typically an alkyl group containing 6 to 22 carbon atoms. The alkanolamide can be, for example, a $C_{18}$ monoethanolamide or an alkanolamide prepared from coconut oil or palm kernel oil, such as those manufactured by Albright and Wilson Americas Inc. (Glen Allen, Va.) sold under the trade mark EMPILAN® CME.

The alkanolamide can also be a polyalkoxylated alkanolamide of the following formula $$R_7\overset{\overset{\displaystyle O}{\|}}{C}NR_8-R_9(OR_{10})_a \qquad \text{(IV)}$$

where $R_7$ is an alkyl, alkenyl, alkylene, hydroalkyl group or polyalkoxylated alkyl, $R_{10}$ is an alkyl group and n is a positive integer. $R_8$ and $R_9$ are independently selected from hydrogen, alkyl (e.g., a $C_1$–$C_8$ alkane), hydroalkyl (e.g., a $C_1$–$C_8$ alkanol) or polyalkoxylated alkyl (e.g., a $C_1$–$C_8$ alkanols). $R_7$ is typically an alkyl group containing 6 to 22 carbon atoms. $R_{10}$ is typically a $C_1$–$C_3$ alkane. $R_8$ is typically hydrogen, alkyl (e.g., a $C_1$–$C_8$ alkane) or hydroalkane. $R_9$ is typically alkyl or hydroalkyl (e.g., a $C_1$–$C_8$ alkanol). The degree of polyalkoxylation (the molar ratio of the oxyalkyl groups per mole of alkanolamide) can range from about 1 to about 100, or from about 3 to about 8, or about 5 to 6. The polyalkoxylated alkanolamide is typically a polyalkoxylated monoalkanolamide, such as a $C_{16}$ and/or $C_{18}$ polyalkoxylated mono alkanolamide or a polyalkoxyated alkanolamide prepared from coconut oil or palm kernel oil.

Methods of manufacturing polyalkoxylated alkanolamides are known to the skilled artisan. (See, e.g., U.S. Pat. No. 6,034,257 the disclosure of which is incorporated by reference herein.) Sources for the manufacture of such alkanolamides include beef tallow, palm kernel oil, palm stearin oil, coconut oil, soybean oil, canola oil, cohune oil, palm oil, white grease, cottonseed oil, and mixtures or fractions thereof. Other sources include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$, ricinoleic ($C_{18}$), arachidic ($C_{20}$), gadolic ($C_{20}$), behenic ($C_{22}$) and erucic ($C_{22}$) fatty acids. Alkanolamides prepared from one or more of these sources are within the scope of the present invention.

Effective amounts of alkanolamide (e.g., an amount which exhibits the desired surfactant properties) can range from at least about one weight percent, more typically about 2.5 weight percent to about 5 weight percent, or more.

Suitable secondary anionic surfactant include those surfactants that contain a long chain, hydrocarbon hydrophobic group in their molecular structure and a hydrophilic group, i.e., water solubilizing group, such as carboxylate, sulfonate, sulfate or phosphate groups. Suitable secondary anionic surfactants include salts, such as sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl or alkaryl group containing from 8 to 22 carbon atoms and a sulfonic or sulfuric acid ester group. Examples of such anionic surfactants include water soluble salts of alkyl benzene sulfonates having between 8 and 22 carbon atoms, in the alkyl group, and alkyl ether sulfates having between 8 and 22 carbon atoms in the alkyl group. Other anionic surfactants include polyethoxylated alcohol sulfates, such as those sold under the trade name CALFOAM® 303 (Pilot Chemical Company, California). Examples of other anionic surfactants are disclosed in U.S. Pat. No. 3,976,586, the disclosure of which is incorporated by reference herein. Other anionic surfactants include alkyl or alkenyl sulfates, olefin sulfonates, alkyl or alkenyl ether carboxylates, amino acid-type surfactants, N-acyl amino acid-type surfactants, and those disclosed in U.S. Pat. Nos. 5,945,394 and 6,046,149, the disclosures of which are incorporated herein by reference.

In another embodiment, the composition comprises only minor amounts of secondary anionic surfactants. As used in this context, a "minor amount" of secondary anionic surfactant is between about 0.5 and about 5 weight percent. Alternatively, the composition is substantially free of secondary anionic surfactants. In this context, the term "substantially free" means less than about one weight percent.

Suitable builders include silicates, including polysilicates and alkali metal silicates. One suitable alkali metal silicate is sodium silicate, such as a hydrous sodium silicate having an $SiO_2$ to $Na_2O$ ratio ranging from about 2.0 to about 2.5, including those sold by PQ Corporation under the trade names BRITESIL® H20, BRITESIL® H24, and BRITESIL C-24. Other suitable silicates include wholly or partially crystallite layer-form silicates of the following formula (V):

$$Na_2Si_x.O_{2x+1}yH_2O, \quad (V)$$

where x ranges from about 1.9 to about 4 and y ranges from 0 to about 20. Such silicates are described, for example, in U.S. Pat. No. 5,900,399, the disclosure of which is incorporated herein by reference.

Other suitable builders include phyllosilicates or disilicates. Disilicates include those having the formula $Na_2O.2SiO_2$ or $Na_2Si_2O_5.yH_2O$, where y is an integer. Preferred disilicates include β-sodium disilicates, such as those described in International Patent Publication WO 91/08171, the disclosure of which is incorporated herein by reference. Disilicates sold under the; trade names SKS® 6 and SKS® 7 by Hoescht AG and Clariant Corporation can also be employed.

Builders can also include silicated salts. The term "silicated salt" means a salt, such as a carbonate, sulfate, alkali metal carbonate, alkali metal sulfate, ammonium carbonate, bicarbonate, sesquicarbonate, or mixtures thereof, that has been treated with a silicate salt. Silicated salts can be prepared, for example, according to the method disclosed in U.S. Pat. No. 4,973,419, the disclosure of which is incorporated herein by reference.

Other builders include phosphate-containing builders, such as, for example, alkali metal phosphates, orthophosphates, polyphosphates, tripolyphosphates, pyrophosphates, polymer phosphates, and aluminosilicate builders (zeolites). Aluminosilicate builders include those of the following formulae (VI) and (VII):

$$Na_z[(AlO_2)_z(SiO_2)_y]_{\cdot xH}2O \quad (VI)$$

where z and y are integers greater than 5, x is an integer ranging from 15 to 264, and the molar ratio of z to y ranges from about 1.0 to about 0.5; and $$M_z(zAlO_2.ySiO_2) \quad (VII)$$

where M is sodium, potassium, ammonium, or substituted ammonium, z ranges from about 0.5 to about 2, and y is 1. Examples of such aluminosilicate builders include zeolite NaA, zeolite NaX, zeolite P, zeolite Y, hydrated zeolite 4A, and zeolite MAP (maximum aluminum zeolite; see, e.g., EP 384 070A). In another embodiment, the second portion contains less than about one weight percent of aluminosilicates and/or phosphate. In still another embodiment, the composition is substantially free of aluminosilicates and phosphates.

Suitable polymer dispersants include polymers of acrylic acid, methacrylic acid, maleic acid, fumaric acid, itaconic acid, co-polymers thereof, and water-soluble salts thereof, such as alkali metal, ammonium, or substituted ammonium salts. Suitable polymer dispersants further include those sold under the trade names ACUSOL® 445 (polyacrylic acid), ACUSOL® 445N (polyacrylic acid sodium salt), ACUSOL® 460N (a maleic acid/olefin copolymer sodium salt), and ACUSOL® 820 (acrylic copolymer), sold by Rohm and Haas Company.

Suitable oxidizing agents include chlorine and non-chlorine-containing oxidizing agents. Suitable non-chlorine oxidizing agents include oxygen bleaches, such as peiborates, percarbonates, persulfates, dipersulfates, sodium carbonate peroxyhydrate, sodium pyrophosphate peroxyhydrate, urea peroxyhydrate, and sodium peroxide. Other suitable non-chlorine oxidizing agents include bleach activators, such as N,N,N',N'-tetraacetyl ethylene diamine (TAED), sodium benzoyl oxybenzene sulfonate, choline sulfophenyl carbonate, and those described in U.S. Pat. Nos. 4,915,854 and 4,412,934, the disclosures of which are incorporated herein by reference. Suitable non-chlorine oxidizing agents further include a catalyst such as manganese or other transition metal(s) in combination with oxygen bleaches.

Suitable oxidizing agents further include percarboxylic acid bleaching agents and salts thereof, such as magnesium monoperoxyphthalate hexahydrate and the magnesium salts of meta-chloro perbenzoic acid, 4-nonylamino-4-oxoperoxybutyric acid and diperoxydodecanedioic acid.

Suitable oxidizing agents also include those described in U.S. Pat. Nos. 4,483,781; 4,634,551; and 4,412,934, the disclosures of which are incorporated by reference herein.

Suitable oxidizing agents further include non-oxygen containing oxidizing agents, such as photoactivated bleaching agents. Suitable photoactivated bleaching agents include sulfonated zinc and metal phthalocyanines, such as aluminum and zinc phthalocyanines. Other suitable photoactivated bleaching agents are described in U.S. Pat. No. 4,033,718, the disclosure of which is incorporated herein by reference.

The oxidizing agent can also be a chlorine-containing agent. The chlorine-containing agent can be any suitable anhydrous agent containing chlorine, such as organic and/or inorganic compounds capable of having their chlorine liberated in the form of active chlorine on dissolution in water. Typical examples of such chlorine-containing agents include the following: hypochlorites such as alkali metal (calcium and lithium) hypochlorites; chlorinated trisodium phosphate; chlorinated sulphonamides; halogenated hydantoins, such as 1,3-dichloro-5,5-dimethylhydantoin; polychlorocyanurates (usually containing alkali metals such as sodium or potassium salts); chlorine-substituted isocyanuric acid; alkali-metal salts of isocyanuric acid, such as potassium or sodium dihydrate; and other anhydrous chlorine-containing agents known in the detergent industry. Typically, the anhydrous chlorine-containing agent is sodium dichloroisocyanurate-dihydrate.

Suitable biocidal agents include TAED, TAED combined with a persalt, triclosan (5-chloro-2 (2,4-dichloro-phenoxy) phenol), and quaternary ammonium compounds such as alkyl dimethyl ammonium chlorides, alkyl trimethyl ammonium chlorides, dialkyl dimethyl ammonium chlorides, benzalkonium chloride, parachlorometaxylene, and alkyl dimethyl benzyl ammonium chloride. Other biocidal agents include those sold under the trademarks BARDAC® (quaternary ammonium compounds, dialkyl dimethyl ammonium chlorides) and BARQUAT® (quaternary ammonium compounds, alkyl dimethyl benzyl ammonium chlorides) by the Lonza Group and those sold under the trademark BTC® (dimethyl ammonium chlorides) by the Stepan Company.

Suitable optical brighteners include stilbenes such as TINOPAL® AMS sold by Ciba Geigy, distyrylbiphenyl derivatives such as TINOPAL® CBS-X sold by Ciba Geigy, stilbene/naphthotriazole blends such as TINOPAL® RA-16 sold by Ciba Geigy, oxazole derivatives, and coumarin brighteners.

Suitable enzymes include any of those known in the art, such as amylolytic, proteolytic or lipolytic types, and those listed in U.S. Pat. No. 5,324,649, the disclosure of which is incorporated herein by reference. One preferred protease, sold under the trademark SAVINASE® by NOVO Industries A/S, is a subtillase from *Bacillus lentus*. Other suitable enzymes include amyinlases, lipases, and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (protein-engineered variant of LIPOLASE), LIPOPRIME™ (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novo Industries A/S.

Suitable fillers and salts include inorganic salts such as sodium and potassium sulfate, ammonium chloride, sodium and potassium chloride, sodium bicarbonate, and the like.

Suitable polymeric soil release agents are characterized as having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures. Suitable release agents include polyhydroxy fatty acid amide, sulfonated products of a substantially linear ester oligomer comprised of an oligomeric ester backbone of terephthaloyl and oxyalkyleneoxy repeat units and terminal moieties covalently attached to the backbone. Such sulfonated linear esters can be derived from allyl alcohol ethoxylate, dimethyl terephthalate, and 1,2 propylene diol. These soil release agents are described in U.S. Pat. No. 5,958,451, the disclosure of which is incorporated herein by reference. Other suitable polymeric soil release agents include the ethyl- or methyl-capped 1,2-propylene terephthalatepolyoxyethylene terephthalate polyesters (see, e.g., U.S. Pat. No. 4,711,730), anionic end-capped oligomeric esters (see e.g., U.S. Pat. No. 4,721,580), anionic, especially sulfoaryl, end-capped terephthalate esters (see e.g., U.S. Pat. No. 4,877,896), all of these patents being incorporated herein by reference. Cellulosic derivatives that are functional as soil release agents are commercially available and include hydroxyethers of cellulose such as METHOCEL® (Dow Chemical).

Suitable soil suspending agents include polyhydroxy fatty acid amides, cellulosic derivatives such as hydroxyether cellulosic polymers, copolymeric blocks of ethylene terephthalate or propylene terephthalate with polyethylene oxide or polypropylene oxide terephthalate, and the like. As will be appreciated by the skilled artisan, the second portion can further include other components.

The first portion is formed from one or more α-sulfofatty acid esters. For example, the first portion can be formed from pure α-sulfofatty acid ester or from a mixture of purified α-sulfofatty acid esters, such as by shaving, granulating or grinding larger blocks, pieces or chunks of one or more α-sulfofatty acid esters, by aliquot portions of liquid α-sulfofatty acid esters, or a combination thereof. In another embodiment, the first portion includes other detergent components. Such components can be mixed with the α-sulfofatty acid ester by, for example, dry-blending, agglomeration, fluid bed mixing, and the like. Such methods preferably do not cause more than a minor amount of additional di-salt formation, such as occurs when α-sulfofatty acid esters are spray dried in the presence of high pH components.

Suitable methods for forming the second portion include agglomeration, spray drying, dry blending, fluid bed mixing and similar methods known to the skilled artisan. Other suitable methods include those described in *Perry's Chemical Engineers' Handbook* ($6^{th}$ Ed.), chapter 19 (1984), the disclosure of which is incorporated by reference herein. The second portion can also be formed by mixing and granulating in a high-speed mixer/granulator. Water or other solvents can be used in forming this portion. Following mixing, the mixture can be formed into any suitable shape, including a powder, beads, pellets, granules, and the like. The second portion is optionally at least partially dried to remove excess free moisture (e.g., moisture other than water of crystallization). For example, the second portion can be dried in a fluidized bed dryer. The free moisture content of the second portion is preferably less than about 10 percent by weight, more typically less than about 6 weight percent, and more typically to between about 1 to about 3 weight percent By removing excess free moisture before admixing the second portion and the first portion, the amount of additional di-salt formation can be reduced.

In one embodiment, the second portion is formed by dry-blending one or more detergent components. For example, sodium carbonate can be combined with a nonionic surfactant. After the nonionic surfactant is absorbed by the carbonate, other ingredients, such as brightener and sodium metasilicate, are then added to the mixture to form the second portion. That portion is optionally dried to reduce its free moisture content. One or more enzymes or fragrance, for example, can optionally be admixed with the second portion or added as separate, adjuvant portions.

In another embodiment, the second portion is formed by agglomeration. For example, one or more detergent components are blended with an inert (e.g., absorbent) ingredient, such as soda ash. The mixture is then agglomerated with a silicate, such as sodium silicate, and optionally, a polymer dispersant. Following agglomeration, the mixture is dried using a fluid bed dryer or conditioner to form the second portion. The dried mixture is then screened, and the oversize particles are ground to the desired size. Following screening, fragrance, an oxidizing agent (e.g., peroxide) and/or enzymes are optionally added to the second portion or added as a separate adjuvant portion(s).

In yet another embodiment, the second portion is formed by spray drying. Briefly, detergent components, such as, for example, water, soda ash, brightener, silicate and polymer dispersant (e.g., polyacrylate), are spray dried and then passed through a lump breaker and/or screens. The free moisture content of the second portion is typically between about 1 to about 6 weight percent. Other methods of forming the second portion are also within the scope of the invention, as will be appreciated by the skilled artisan.

Following forming of the first and second portions, the first (α-sulfofatty acid ester) portion is post-added to the second portion. As used herein, the terms "post-added," "post-adding" or "post addition" refer to the addition of the first (α-sulfofatty acid ester) portion, as a separate portion, to the second portion after formation of the second portion. The second portion is typically formed by processes, or includes detergent components, that cause additional di-salt formation. Such processes include spray-drying, drying at elevated temperature, mixing alkalizing agents or high pH components, and the like. By admixing the α-sulfofatty acid ester after the second portion is formed, the amount of additional di-salt formation is reduced. In a preferred embodiment, post-addition of α-sulfofatty acid ester prevents more than a minor amount of additional di-salt formation.

The α-sulfofatty acid first portion or second portion can optionally be at least partially coated to protect the α-sulfofatty acid ester from additional di-salt formation. Such a coating can prevent the interaction of the α-sulfofatty acid ester with bases, moisture, and other di-salt causing components. Such a coating can be water-resistant. The coating typically can have a melting point within normal washing temperatures, or it can be water-soluble. For a water-soluble coating, it is not necessary that the coating have a melting point within the range of normal washing temperatures.

Suitable coatings include, for example, polyvinyl alcohol, partially or fully hydrolyzed polyvinyl alcohol, polyvinyl acetate, polyvinyl pyrrolidone, polyvinylmethylmethacrylate copolymer, maleic acid/acrylic acid copolymer, ethylene/maleic anhydride copolymer, polyethylene glycol, acrylic acid polymer, carboxymethyl cellulose, cellulose ether, paraffin waxes, fatty acids, methyl ester sulfonate, soaps, waxes, water-soluble polymers, water-swellable polymers, or copolymers, salts or mixtures of any of these.

The coating can be applied to a portion according to techniques used in the detergent and pharmaceutical industries, as will be appreciated by the skilled artisan. Examples of suitable techniques for applying a coating include dip coating, spin coating, spray coating, spray drying (including spray drying using counter-current or co-current techniques), agglomeration and coating using a fluid bed dryer. Suitable fluid bed dryers include, for example, static, vibrating, high-shear granulating, vacuum fluid bed, tablet pan coating, rotor processing and wurster high speed fluid bed dryers. Following application of a coating to a portion, the coating can be dried, as necessary, to remove excess moisture or other liquid. Other examples are disclosed in U.S. Pat. No. 6,057,280, which is incorporated by reference herein.

Other embodiments of the present invention are exemplified in the following examples, although the invention is not intended to be limited by or to these examples.

EXAMPLES

In these examples, the percentages are given as weight percents, and the weight percentages are based on the total weight of the composition, unless otherwise indicated.

Example 1

A second portion is prepared as follows: a polyalkoxylated alkanolamide is mixed with soda ash until the alkanolamide is absorbed by the soda ash. Sodium silicate builder (2.4:1), sodium chloride or sodium sulfate, polyacrylate, brightener, and a perfume are then agglomerated with the alkanolamide/soda ash mixture. Following agglomeration, the second portion is, dried to, reduce the moisture content to between about 1 to about 6 percent moisture by weight. A first portion comprising at least one α-sulfofatty acid ester is then admixed with the second portion to form a substantially homogeneous mixture of particles. A perfume is optionally added after mixing.

Example 2

A second portion is prepared as follows: a polyalkoxylated alkanolamide is mixed with a builder, a polymer dispersant, filler, perfume and brightener. These components are mixed by spray drying. A first portion, comprising α-sulfofatty acid ester, is then post-added to the second portion. The final proportions of the components are as follows:

| component | weight percent |
|---|---|
| α-sulfofatty acid ester | 10–50% |
| polyalkoxylated alkanolamide | 0.1–5% |
| sodium silicate | 2–5% |
| filler | 0–10% |
| polymer dispersant | 4–6% |
| brightener | 0.1–0.2% |
| perfume | 0.2–0.4% |
| soda ash | balance |
| total moisture of second portion | 1–3% |

Example 3

A second portion is prepared as; follows: a $C_{16}$ and/or $C_{18}$ ethoxylated alkanolamide is mixed with a sodium silicate builder (2.4:1), sodium chloride or sodium sulfate, polyacrylate, brightener, perfume and soda ash. These components are mixed by agglomeration. Following agglomeration, the second portion is dried to reduce the moisture content to between about 1 to about 3 weight percent. The second portion is then combined with powdered methyl ester sulfonate (from tallow or palm stearin). A perfume is then added. The final proportions are as follows:

| component | weight percent |
|---|---|
| methyl ester sulfonate | 35% |
| ethoxylated alkanolamide | 0.1–5% |
| sodium silicate | 2–5% |
| polyacrylate | 4–6% |
| filler | 0–10% |
| brightener | 0.1–0.2% |
| perfume | 0.2–0.4% |
| soda ash | balance |
| total moisture of second portion | 1–3% |

Example 4

A base composition is prepared in the following proportions:

| component | weight percent |
|---|---|
| soda ash | 77.8 |
| sodium silicate solids | 10 |
| ACUSOL ® 445N dispersant (Rohm and Haas) | 10 |
| brightener | 0.2 |
| water | 2 |

The base mixture is combined with a polyalkoxylated alkanolamide and is mixed by agglomeration or spray drying to form a powder. The moisture content of the powder is within the range of about 1 to about 3 weight percent. A powdered α-sulfofatty acid first portion is then admixed with the second portion to form a detergent composition.

Example 5

Four α-sulfofatty acid ester compositions were tested to determine the effect of post-adding α-sulfofatty acid ester to other detergent components. The compositions contained the following components (in weight percentages):

| | Composition | | | |
|---|---|---|---|---|
| Component | A | B | C | D |
| $C_{16}$ α-sulfofatty acid ester | 12 | 25 | 12 | 25 |
| Sodium Silicate | 7 | 7 | 7 | 7 |
| Sodium Carbonate | 81 | 68 | 81 | 68 |

The compositions were incubated at incubated in a humidity chamber at 104° F. and 80% humidity. Samples were removed at different times ("elapsed time") and tested for amount of di-salt formed. The amount of additional di-salt formed is calculated as follows:

$$\frac{\text{amount of di-salt formed} - \text{original di-salt content}}{\text{total amount of active (mono-salt and di-salt)}}$$

This ratio is also referred to as the "% Di-Salt/Active."

Without Post-Adding α-Sulfofatty Acid Ester

| Formula | Elapsed Time (Days) | SASME % mono-salt | SASCA % di-salt | Total Actives | % Di-Salt/ Active |
|---|---|---|---|---|---|
| A | 0 | 10.3 | 0.24 | 10.5 | 0 |
| | 8 | 7.0 | 0.42 | 7.5 | 2.4 |
| | 15 | 7.2 | 0.60 | 7.8 | 4.6 |
| B | 0 | 21.3 | 1.0 | 22.3 | 0 |
| | 8 | 12.6 | 1.6 | 14.2 | 4.2 |
| | 15 | 13.2 | 1.8 | 15.0 | 5.3 |

Post-Adding α-Sulfofatty Acid Ester

| Formula | Elapsed Time (Days) | SASME % mono-salt | SASCA % di-salt | Total Actives | % Di-Salt/ Active |
|---|---|---|---|---|---|
| C | 0 | 10.3 | 0.24 | 10.5 | 0 |
| | 8 | 10.3 | 0.25 | 10.6 | 0.1 |
| | 15 | 10.1 | 0.42 | 10.5 | 1.7 |
| D | 0 | 21.3 | 1.0 | 22.3 | 0 |
| | 8 | 18.0 | 1.1 | 19.1 | 0.5 |
| | 15 | 19.2 | 1.1 | 20.3 | 0.5 |

As can be seen by comparing examples A and C, or B and D, by post-adding the α-sulfofatty acid ester to the other detergent components, a higher percentage of total active α-sulfofatty acid ester (i.e., mono-salt) is retained in the compositions after incubation in the humidity chamber. The ratio of the % di-salt to active is also correspondingly lower. Thus, post-adding α-sulfofatty acid ester to detergent compositions containing di-salt-forming components reduces di-salt formation.

Having thus described in detail the preferred embodiments of the present invention, it is to be understood that the invention defined by the appended claims is not to be limited by particular details set forth in the above description, as many apparent variations thereof are possible without departing from the spirit or scope thereof.

What is claimed is:

1. A granular or powdered detergent composition having reduced di-salt formation, comprising:

first particles ester comprising $C_{16}$ or $C_{18}$ enriched methyl ester sulfonate, wherein the first particles are substantially free of substances that cause more than a minor amount of additional disalt formation; and second particles comprising nonionic surfactant and an additional detergent component that causes more than a minor amount of additional di-salt formation, the second particles having a free moisture content of less than about 6 weight percent, the second particles being free of α-sulfofatty acid ester;

the first particles post-added to the second particles, whereby the first and second particles are commingled, but remain separate and physically distinct.

2. The composition of claim 1, wherein the methyl ester sulfonate is sodium methyl ester sulfonate.

3. The composition of claim 2, wherein the methyl ester sulfonate is a $C_{16}$ enriched methyl ester sulfonate.

4. The composition of claim 1, wherein the methyl ester sulfonate is prepared from beef tallow, palm kernel oil, palm oil, coconut oil, soybean oil, canola oil, cohune oil, coco butter, white grease, cottonseed oil, corn oil, rape seed oil, yellow grease, mixtures or fractions thereof.

5. The composition of claim 1, wherein the second particles further comprise a builder, a secondary anionic surfactant, a polymer dispersant, an oxidizing agent, a biocidal agent, a foam regulator, a binder, an anticaking agent, an activator, a catalyst, a thickener, a stabilizer, a fragrance, a soil suspending agent, a soil release agent, a filler, a brightener, a UV protectant, an enzyme, or a mixture thereof.

6. The composition of claim 5, wherein the builder is sodium silicate, polysilicate, amorphous silicate, phyllosilicate, soda ash, or silicated soda ash.

7. The composition of claim 1, wherein the free moisture content of the second particles is between about 1 to about 3 weight percent.

8. The composition of claim 1, wherein the composition is substantially free of secondary anionic surfactant.

9. A granular or powdered α-sulfofatty acid ester detergent composition, comprising:

detergent particles comprising at least one detergent component that causes more than a minor amount of additional di-salt formation, and nonionic surfactant selected from alkanolamide, polyalkoxylated alkanolamide, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, and glycerol fatty acid esters; the second particles substantially free of α-sulfofatty acid ester, and $C_{16}$ or $C_{18}$ enriched methyl ester sulfonate particles which are substantially free of substances that cause more than a minor amount of additional disalt formation;

the methyl ester sulfonate particles ester post-added to the detergent particles, whereby the methyl ester sulfonate particles and detergent particles are commingled, but remain separate and physically distinct in the detergent composition, and whereby additional di-salt formation is reduced.

10. The composition of claim 9, wherein the methyl ester sulfonate particles are a powder.

11. The composition of claim 9, wherein the methyl ester sulfonate is sodium methyl ester sulfonate.

12. The composition of claim 11, wherein the methyl ester sulfonate is prepared from beef tallow, palm kernel oil, palm oil, coconut oil, soybean oil, canola oil, cohune oil, coco butter, white grease, cottonseed oil, corn oil, rape seed oil, yellow grease, mixtures or fractions thereof.

13. The composition of claim 9, wherein the detergent particles further comprise a builder, a secondary anionic surfactant, a polymer dispersant, an oxidizing agent, a biocidal agent, a foam regulator, a binder, an anticaking agent, an activator, a catalyst, a thickener, a stabilizer, a fragrance, a soil suspending agent, a filler, a brightener, a UV protectant, an enzyme, or a mixture thereof.

14. The composition of claim 9, further comprising adjuvant particles.

15. The composition of claim 14, wherein the adjuvant particles comprise an enzyme, a fragrance or an oxidizing agent.

16. A granular or powdered α-sulfofatty acid ester detergent prepared by:

providing at least one detergent component that causes more than a minor amount of additional di-salt formation;

forming the at least one detergent component by granulating, spray drying or agglomerating into detergent particles, the second particles free of α-sulfofatty acid ester; and post-adding a powdered or agglomerated $C_{16}$ or $C_{18}$ enriched methyl ester sulfonate to the detergent portion so that the methyl ester sulfonate and detergent particles are commingled, but remain separate and physically distinct; whereby the amount of the di-salt formation is reduced.

17. The composition of claim 16, wherein the methyl ester sulfonate is free of components that cause more than a minor amount of additional di-salt formation.

18. The composition of claim 16, further prepared by:

reducing the free moisture content of the detergent particles to between about 1 to about 6 weight percent.

19. The composition of claim 16, wherein the detergent particles are a powder, pellets, beads, or granules.

20. The composition of claim 16, wherein the methyl ester sulfonate is sodium methyl ester sulfonate.

21. The composition of claim 16, further prepared by:

applying a coating to the methyl ester sulfonate.

* * * * *